US009055797B2

(12) United States Patent
Dycus

(10) Patent No.: US 9,055,797 B2
(45) Date of Patent: Jun. 16, 2015

(54) SIZE ADJUSTABLE CARRYING APPARATUS

(71) Applicant: Zachary C. Dycus, Knoxville, TN (US)

(72) Inventor: Zachary C. Dycus, Knoxville, TN (US)

( * ) Notice: Subject to any disclaimer, the term of this patent is extended or adjusted under 35 U.S.C. 154(b) by 0 days.

(21) Appl. No.: 14/218,331

(22) Filed: Mar. 18, 2014

(65) Prior Publication Data

US 2014/0263518 A1 Sep. 18, 2014

Related U.S. Application Data

(60) Provisional application No. 61/803,007, filed on Mar. 18, 2013.

(51) Int. Cl.

| | |
|---|---|
| ***A45C 11/00*** | (2006.01) |
| *A45F 5/02* | (2006.01) |
| *A45F 5/00* | (2006.01) |
| *A45F 3/14* | (2006.01) |

(52) U.S. Cl.
CPC . *A45C 11/00* (2013.01); *A45F 5/02* (2013.01); *A45F 5/00* (2013.01); *A45F 3/14* (2013.01)

(58) Field of Classification Search
USPC ..... 224/600, 148.5, 148.6, 578
See application file for complete search history.

(56) References Cited

U.S. PATENT DOCUMENTS

| | | | | |
|---|---|---|---|---|
| 4,096,977 | A * | 6/1978 | Barville et al. | 224/148.6 |
| 4,570,688 | A * | 2/1986 | Williams | 150/134 |
| 4,998,653 | A * | 3/1991 | LaBelle | 224/578 |
| 5,412,545 | A * | 5/1995 | Rising | 362/105 |
| 5,427,291 | A * | 6/1995 | Smith | 224/250 |
| 5,433,359 | A * | 7/1995 | Flowers | 224/222 |
| 5,450,991 | A * | 9/1995 | Neading | 224/578 |
| 5,624,065 | A * | 4/1997 | Steffe | 224/625 |
| 5,664,712 | A * | 9/1997 | Smrt | 224/250 |
| 5,806,730 | A * | 9/1998 | Deno | 224/148.6 |
| 5,873,551 | A * | 2/1999 | Jones | 248/102 |
| 6,029,870 | A * | 2/2000 | Giacona, III | 224/148.6 |
| 6,131,780 | A * | 10/2000 | Becker | 224/148.6 |
| 6,371,346 | B1 * | 4/2002 | Sharma | 224/578 |
| 6,443,338 | B1 * | 9/2002 | Giacona, III | 224/148.6 |
| 8,668,122 | B2 * | 3/2014 | Case et al. | 224/218 |
| 2003/0127478 | A1 * | 7/2003 | Villarreal, Jr. | 224/251 |
| 2005/0092789 | A1 * | 5/2005 | Giacona, III | 224/148.6 |
| 2005/0227833 | A1 * | 10/2005 | Wilkinson | 482/124 |
| 2006/0163301 | A1 * | 7/2006 | Rhodes et al. | 224/409 |
| 2008/0149672 | A1 * | 6/2008 | Frauhiger | 224/148.6 |
| 2008/0203127 | A1 * | 8/2008 | Castillo-Garrison | 224/607 |
| 2008/0296325 | A1 * | 12/2008 | Tepper | 224/148.6 |
| 2012/0061439 | A1 * | 3/2012 | Wallis | 224/600 |

* cited by examiner

*Primary Examiner* — Brian D Nash
(74) *Attorney, Agent, or Firm* — Dale J. Ream

(57) ABSTRACT

A size adjustable, hands-free carrying apparatus includes an attachment member having opposed first and second ends and opposed first and second side edges. A wrap assembly includes first and second strap members constructed of a flexible material attached to the side edges of the attachment member, respectively, and extending away in opposing directions. A back side of the first strap includes a hook material while a front side of the second strap includes a complementary loop material. The carrying apparatus includes a lanyard having a first end releasably coupled to the first end of the attachment member and a second end forming a loop configured to selectively hang from the neck of a person. The straps of the wrap assembly may be wrapped securely around an article such that the article may be suspended from a person's neck by the lanyard.

10 Claims, 5 Drawing Sheets

SIZE ADJUSTABLE CARRYING APPARATUS

REFERENCE TO RELATED APPLICATION

This application claims the priority of U.S. Provisional Patent Application No. 61/803,007 filed on Mar. 18, 2013 titled "Neoprene/Velcro "wrappable" configuration, attached to a lanyard, for carrying small personal things" which is incorporated by reference in its entirety herein.

BACKGROUND OF THE INVENTION

This invention relates generally to devices for transporting various articles and, more particularly, to a hands-free carrying apparatus having a size adjustable wrap assembly configured to carry a multiplicity of small or personal items.

Carrying personal items may be difficult when a handbag or pockets are unavailable or when the need for keeping one's hands free is of critical importance. For instance, carrying a wallet or cell phone to the beach is often a problem in that a swimsuit lacks pockets. Carrying personal items is also difficult when riding a bicycle or operating an automobile. In another situation, a person may desire to carry a miniature flashlight at night for safety or convenience reasons.

Various devices have been proposed for carrying small personal items. Although assumably effective for their intended uses, such devices and proposals are not universal to hold different size items. For instance, a pocket has one size as does a bag or briefcase. Therefore, it would be desirable to have a carrying apparatus that may securely wrap around a selected object regardless of its size and be secured accordingly. Further, it would be desirable to have a carrying apparatus that may be suspended from a user's neck so as to be conveniently accessible when needed but hands-free when not needed.

SUMMARY OF THE INVENTION

A size adjustable, hands-free carrying apparatus according to a preferred embodiment of the present invention includes an attachment member having opposed first and second ends and opposed first and second side edges extending therebetween. A wrap assembly includes first and second strap members constructed of a flexible material attached to the first and the second side edges of the attachment member, respectively, and extending away in opposing directions. A back side of the first strap includes a hook material of a hook and loop fastener combination. A front side of the second strap includes a loop material of a hook and loop fastener combination. The carrying apparatus includes a lanyard having a first end releasably coupled to the first end of the attachment member and a second end forming a loop configured to selectively hang from the neck of a person. The straps of the wrap assembly may be wrapped around an article such that the article may be suspended from a person's neck by the lanyard.

Therefore, a general object of this invention is to provide a carrying device that enables a user to carry small items without the use of hands or pockets.

Another object of this invention is to provide a carrying device, as aforesaid, having a pair of straps configured to securely surround an object and hold the item securely in a hook and loop fastener arrangement.

Still another object of this invention is to provide a carrying device, as aforesaid, that includes a lanyard so that objects being carried may be suspended from a user's neck.

Yet another object of this invention is to provide a carrying device, as aforesaid, which enables a user to quickly secure or release an object in a wrap assembly.

A further object of this invention is to provide a carrying device, as aforesaid, that is user friendly.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
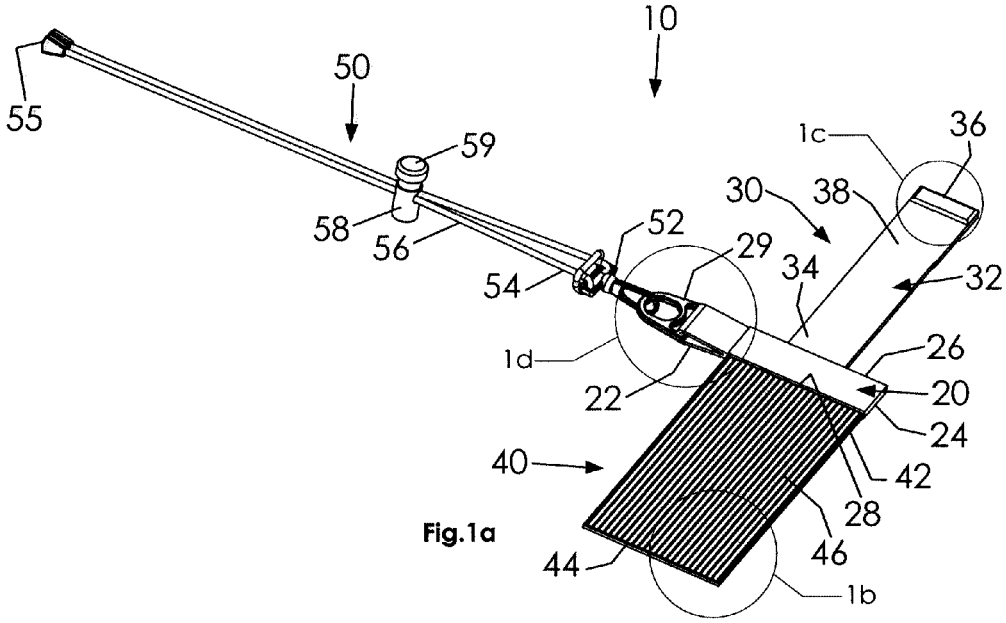
FIG. 1*a* is a front perspective view of a size adjustable carrying apparatus according to a preferred embodiment of the present invention
Figure 1E:
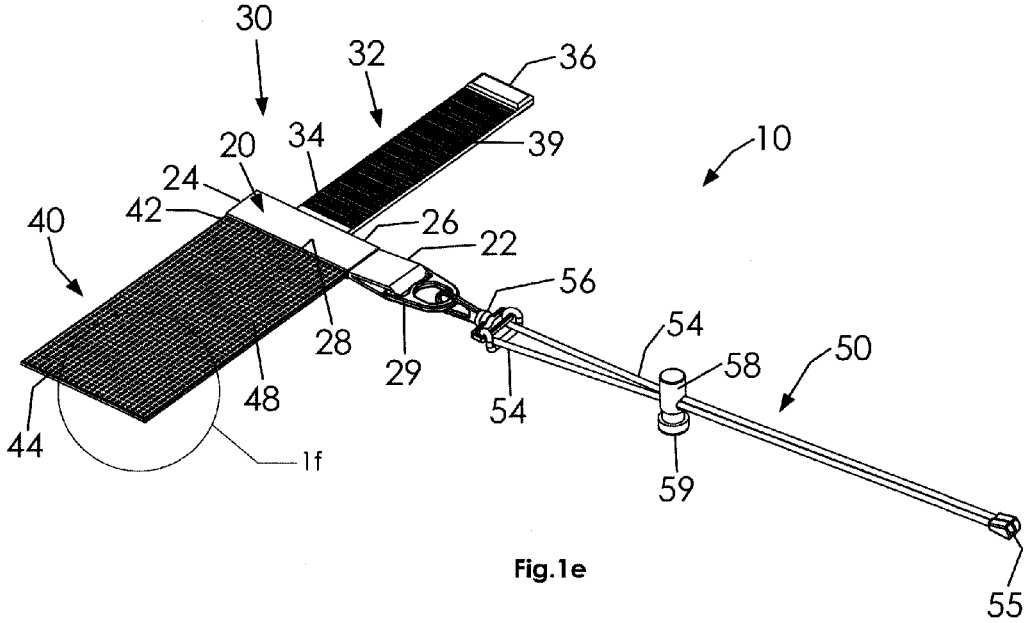
FIG. 1*e* is a is a back perspective view of the carrying apparatus as in FIG. 1*a;*
Figure 1B:
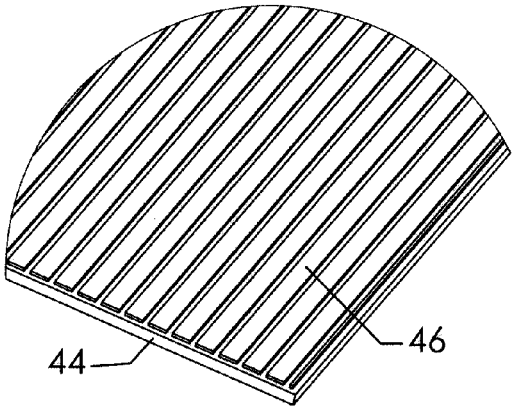
FIG. 1*b* is an isolated view on an enlarged scale taken from FIG. 1*a;*
Figure 1C:
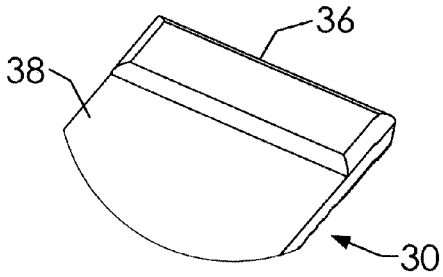
FIG. 1*c* is an isolated view on an enlarged scale taken from FIG. 1*a;*
Figure 1D:
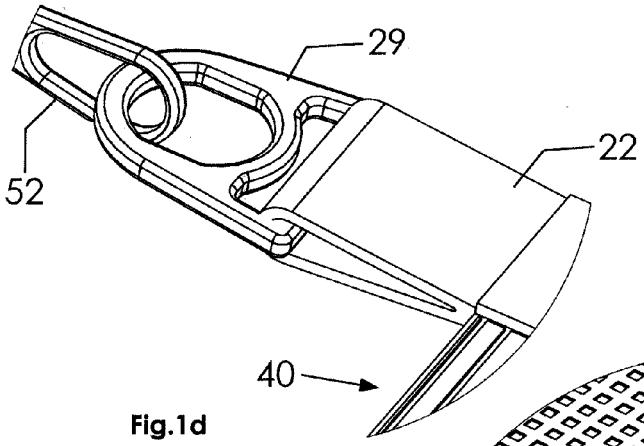
FIG. 1*d* is an isolated view on an enlarged scale taken from FIG. 1*a;*
Figure 1F:
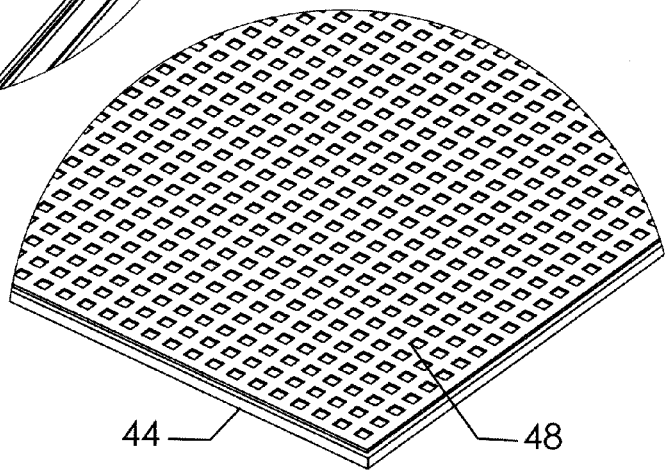
FIG. 1*f* is an isolated view on an enlarged scale taken from FIG. 1*b;*
Figure 2A:
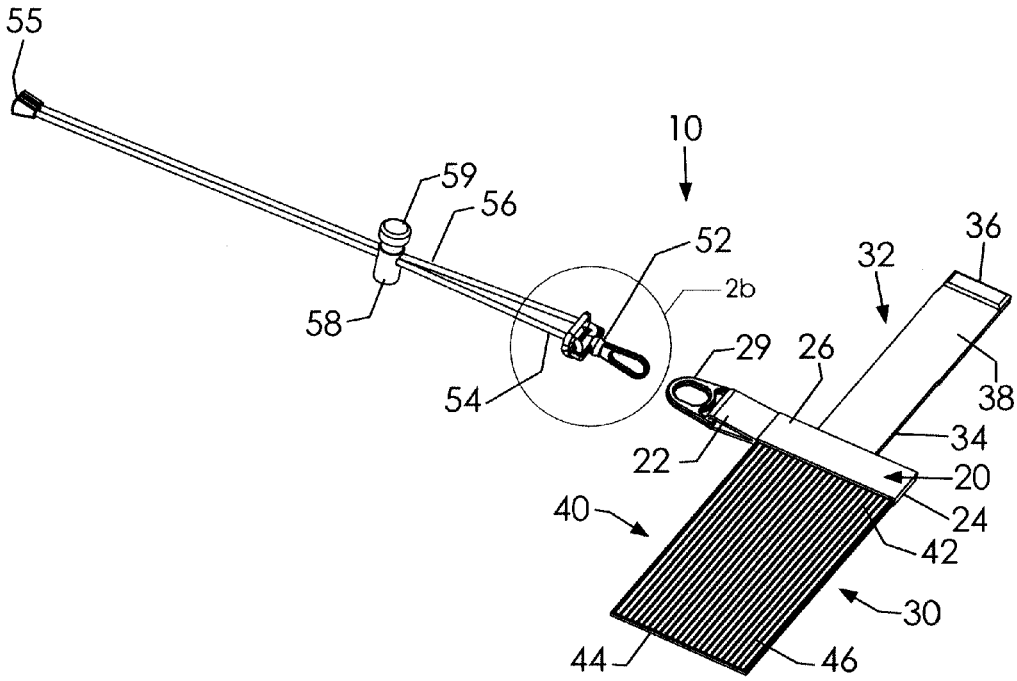
FIG. 2*a* is an exploded view of the carrying apparatus as in FIG. 1*a;*
Figure 2B:
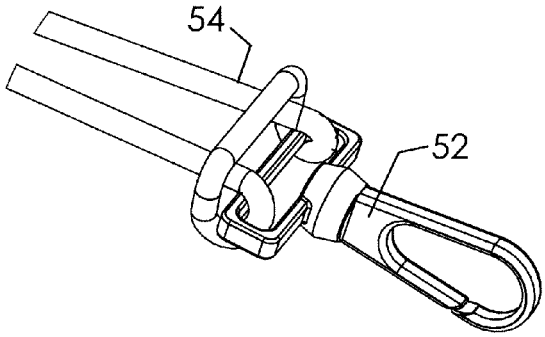
FIG. 2*b* is an isolated view on an enlarged scale taken from FIG. 2*a;*

A size adjustable and hands-free carrying apparatus according to a preferred embodiment of the present invention will now be described in detail with reference to FIGS. 1*a* to 4 of the accompanying drawings. The carrying apparatus 10 includes a size adjustable wrap assembly 30 and a lanyard 50.

The carrying apparatus includes an attachment member 20 having opposed first 22 and second 24 ends between which defines a length dimension. The attachment member 20 includes opposed first 26 and second 28 side edges extending between the first 22 and second 24 ends and between which defines a width dimension. Preferably the length dimension of the attachment member 20 is greater than the width dimension. The first end 22 of the attachment member 20 may include a loop configuration or may be viewed as a hemmed fabric end defining a slot through which other components may be selectively attached as will be described later.

The wrap assembly 30 includes a first strap 32 and a second strap 40. The first strap 32 includes a proximal end 34 coupled to the first side edge 26 of the attachment member 20 and extends away therefrom to an opposed distal end 36. Similarly, the second strap 40 includes a proximal end 42 coupled to the second side edge 28 of the attachment member 20 and extends away therefrom to an opposed distal end 44. Each respective strap has a generally planar configuration and is constructed of a flexible material, such as a fabric material.

Preferably, a front side 38 of the first strap 32 includes a fabric material having a visually decorative appearance, such as having a plurality of visually ornamental indicia. An opposed back side 39 of the first strap 32, by contrast, may include a hook material in the nature of the hook and loop material commonly sold under the registered trademark Velcro®. The hook material covers substantially an entirety of the back side 39 of the first strap 32.

Preferably, a front side 46 of the second strap 40 includes a loop material of the hook and loop combination type of fastener. The hook and loop materials of respective sides of the first 32 and second 40 straps are configured to enable the straps to be releasably coupled to one another as will be described later. The loop material covers substantially an entirety of the front side 46 of the second strap 40.

A back side 48 of the second strap 40 includes a layer of neoprene configured to enhance the grip of the back side 48 and to reduce or eliminate slippage when wrapped around an article as will be described later. Neoprene, also known as polychoroprene, is in the family of synthetic rubber materials having anti-slip characteristics. The layer of neoprene covers substantially the entire mathematical area of the back side 48 of the second strap 40.

Figure 4:
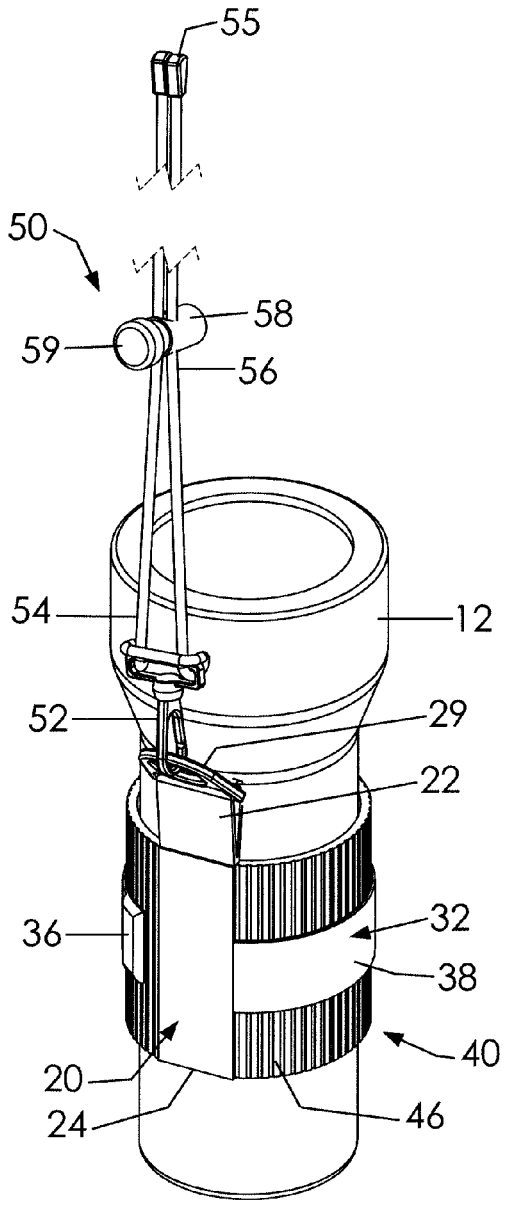
FIG. 4 is a perspective view of the carrying apparatus in use secured to an article (a flashlight).

The first strap 32 defines a width that is smaller than a width of the second strap 40. More particularly, the first strap 32 has a generally elongate linear configuration. Conversely, the back side 48 of the second strap 40 defines a mathematical area that is about twice an area of the first strap 32 and is configured to bear against and grip an outer surface of an article to be securely carried by the wrap assembly 30. For instance, the back side 48 of the second strap 40 (i.e. neoprene side) may be first wrapped around an article, such as a min-flashlight, cell phone, or the like, and then the first strap 32 may be tightly wrapped around the article and the back side 39 of the first strap 32 coupled to the front side 46 of the second strap 40 in a hook and loop fastener engagement (FIG. 4).

With more particular regard to the straps of the wrap assembly 30, the wrap assembly 30 is movable between a released configuration (FIG. 1*a*) in which the back side 39 of the first strap 32 is unattached to and displaced from the front side 46 of the second strap 40 and an engaged configuration (FIG. 4) at which the back side 39 of the first strap 32 is coupled to the front side 46 of the second strap 40 in a hook and loop engagement.

Because the hook and loop materials described above are disposed on a substantial entirety of respective sides of respective straps, the straps may be selectively positioned and coupled relative to one another so as to adjust the relative size of the wrap assembly 30. More particularly, the first strap 32 is able to be wrapped around a small article, such as a cell phone, such that the distal end 36 of the first strap 32 may be adjacent the proximal end 42 of the second strap 40 at the engaged configuration. By contrast, the first strap 32 may be wrapped around a larger article, such as an electronic tablet, such that the distal end 36 of the first strap 32 is substantially displaced from the proximal end 42 of the second strap 40 when at the engaged configuration. FIG. 4 illustrates the wrap assembly 30 in use wrapped around a miniature flashlight 12.

The lanyard 50 enables the wrap assembly 30 to be suspended from the neck of a person. An attachment flange 29 is pivotally coupled to the first end 20 of the attachment member 20. The attachment flange 29 may be a ring-shaped fastener having an end extending through the open space defined by the first end 22 of the attachment member 20 as described above. This attachment provides more freedom of movement of the wrap assembly 30 and also so the attachment flange 29 may be moved to a stowed configuration (FIG. 3) as will be described below. Further, a clip member 52 is rotatably coupled to a first end 54 of the lanyard 50. More particularly, the clip member 52 may be a swivel clip configured to rotate 360 degrees such that the wrap assembly 30 is free to be rotated by a person wearing the carrying apparatus 10.

The lanyard 50 may include a pair of cords extending away from the lanyard first end 54, each cord having a free end 55 (FIG. 4). The lanyard 50 also includes an adjustment member 58 slidably coupled to the pair of cords and movable so as to change the size of the loop defined by the lanyard 50. The "loop" formed by the cords intersecting at the adjustment member 58 may be referred to as a second end 56 of the lanyard 50. In other words, a user is able to tighten the loop of the lanyard 50 about his neck when hanging therefrom. The adjustment member 58 may include a push-button adjuster 59 configured to selectively lock the adjustment member 58 at a selected configuration or to release it to move up or down along the cords.

Figure 3:
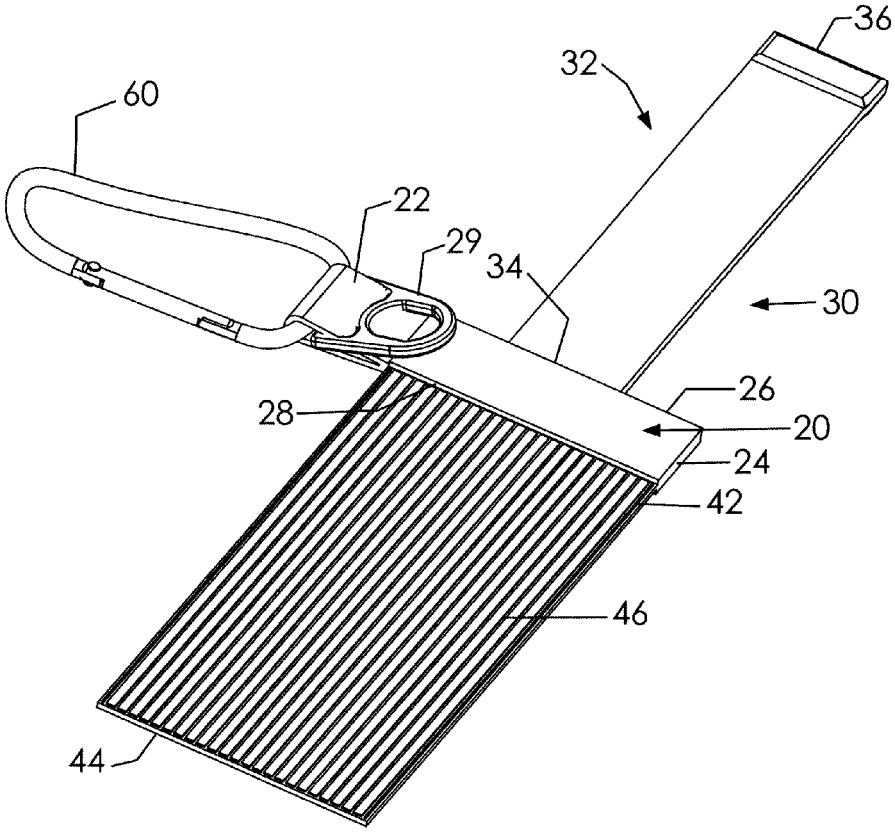
FIG. 3 is a perspective view of a wrap assembly removed from the lanyard and in use with a carabineer.

In one embodiment, the carrying apparatus 10 may include a carabineer 60 that may be releasably coupled to the first end 22 of the attachment member 20 (FIG. 3). The carabineer 60 includes a spring loaded bar that may be opened so that the carabineer 60 may be latched to or released from the first end 22 of the attachment member 20. In use, the lanyard 50 may be released from the wrap assembly 30 and the carabineer 60 may be coupled thereto, thus enabling the wrap assembly 30 to be coupled to a person's belt, belt loop, bag, or the like. It is understood that the attachment flange 29 must be pivoted to the stowed configuration in order for the carabineer 60 to be coupled to the first end 22 of the attachment member 20 (FIG. 3).

In use, the wrap assembly 30 may first be moved to the released configuration to prepare for wrapping an article therein (FIG. 1*a*). Then, an item to be wrapped up may be positioned upon the back side 48 (neoprene surface) of the second strap 40 and the second strap 40 wrapped around the item. Then, the first strap 32 may also be wrapped around the article until the hook material on the back side 39 of the first strap 32 is engaged with the loop material on the front side 46 of the second strap 40. The article is now securely held by the wrap assembly 30. Now the lanyard 50 may be coupled to the wrap assembly 30 as described above such that the article secured by the wrap assembly 30 is suspended from the neck of the user and eminently available when needed. It is understood that the article is able to be carried with no involvement of the user's hands.

It is understood that while certain forms of this invention have been illustrated and described, it is not limited thereto except insofar as such limitations are included in the following claims and allowable functional equivalents thereof.

The invention claimed is:

1. A size adjustable, hands-free carrying apparatus, comprising:

an attachment member having opposed first and second ends and opposed first and second side edges extending therebetween;

a wrap assembly having first and second straps attached to said first and said second side edges of said attachment member, respectively, and extending away in opposing directions;

wherein a back side of said first strap includes a hook material of a hook and loop fastener combination;

wherein a front side of said second strap includes a loop material of a hook and loop fastener combination; and a lanyard having a first end releasably coupled to said first end of said attachment member and a second end forming a loop configured to selectively hang from the neck of a person;

an attachment flange pivotally coupled to said first end of said attachment member; and a clip member rotatably coupled to said first end of said lanyard, said clip member selectively and releasably coupled to said attachment flange.

2. The carrying apparatus as in claim 1, wherein a back side of said second strap includes neoprene material configured to enhance grip.

3. The carrying apparatus as in claim 2, wherein a front side of said first strap includes a fabric material having visual indicia imprinted thereon.

4. The carrying apparatus as in claim 1, wherein said first strap includes a width that is smaller than a width of said second strap.

5. The carrying apparatus as in claim 4, wherein:

a back side of said second strap includes a polychloroprene material configured to enhance grip, said polychloroprene material covering substantial an entirety of said back side of said second strap; and said second strap defines a mathematical area about twice a mathematical area of said first strap and is configured to bear against a surface of an article to be carried by said wrap assembly.

6. The carrying apparatus as in claim 1, wherein:

said first strap and said second strap are constructed of a flexible material so as to selectively surround an article carried by said wrap assembly; and said wrap assembly is movable between a released configuration at which said first strap is displaced from and unattached to said second strap and an engaged configuration at which said back side of said first strap is coupled to said front side of said second strap in a hook and loop engagement.

7. The carrying apparatus as in claim 6, wherein:

said hook material covers substantially an entirety of said back side of said first strap;

said loop material cover substantially an entirety of said front side of said second strap; and said back side of said first strap is selectively coupled to a selectable portion of said front side of said second strap at said engaged configuration.

8. The carrying apparatus as in claim 1, wherein said lanyard includes:

a pair of cords extending away from said lanyard first end, each cord having a free end; and a length adjustment member in communication with said pair of cords and slidable therealong so as to change the size of said loop.

9. The carrying apparatus as in claim 1, comprising a carabineer releasably coupled to said first end of said attachment member.

10. A size adjustable, hands-free carrying apparatus, comprising:

an attachment member having opposed first and second ends and opposed first and second side edges extending therebetween;

a wrap assembly having first and second straps attached to said first and said second side edges of said attachment member, respectively, and extending away in opposing directions;

wherein a back side of said first strap includes a hook material of a hook and loop fastener combination;

wherein a front side of said second strap includes a loop material of a hook and loop fastener combination;

a lanyard having a first end releasably coupled to said first end of said attachment member and a second end forming a loop configured to selectively hang from the neck of a person;

an attachment flange pivotally coupled to said first end of said attachment member; and a clip member rotatably coupled to said first end of said lanyard, said clip member selectively and releasably coupled to said attachment flange; and a carabineer releasably coupled to said first end of said attachment member said clip member is released from said attachment flange and when said attachment flange is pivoted to a stowed configuration.

* * * * *